US009505583B1

(12) United States Patent
Hellbusch

(10) Patent No.: US 9,505,583 B1
(45) Date of Patent: Nov. 29, 2016

(54) NOZZLE HOLDER FOR A HOSE REEL

(71) Applicant: James A. Hellbusch, Columbus, NE (US)

(72) Inventor: James A. Hellbusch, Columbus, NE (US)

( * ) Notice: Subject to any disclaimer, the term of this patent is extended or adjusted under 35 U.S.C. 154(b) by 18 days.

(21) Appl. No.: 14/701,710

(22) Filed: May 1, 2015

(51) Int. Cl.
*B65H 75/44* (2006.01)
*B65H 75/42* (2006.01)

(52) U.S. Cl.
CPC ..... *B65H 75/425* (2013.01); *B65H 75/44* (2013.01); *Y10T 137/5762* (2015.04); *Y10T 137/6899* (2015.04); *Y10T 137/6921* (2015.04); *Y10T 137/6954* (2015.04)

(58) Field of Classification Search
CPC ..... B65H 75/425; B65H 75/44; Y10T 137/6899; Y10T 137/6921; Y10T 137/5762; Y10T 137/6954
USPC ..... 137/312, 313, 314, 355.12, 355.19, 137/355.2, 355.26, 355.27; 141/86, 392; 222/108, 538, 191
See application file for complete search history.

(56) References Cited

U.S. PATENT DOCUMENTS 2,595,655 A * 5/1952 Hannay ..... B65H 75/38 137/355.2
2,615,756 A * 10/1952 Granberg ..... B65H 75/4478 137/355.2
2,650,776 A * 9/1953 Risser, Jr. ..... B67D 7/40 137/355.2
2,735,717 A * 2/1956 Harman ..... B64F 1/28 137/355.12
2,971,528 A * 2/1961 Rocca ..... B60T 17/046 137/355.12
3,291,165 A * 12/1966 Fraylick ..... B67D 7/421 141/286
3,958,594 A * 5/1976 Masters ..... B65H 75/38 137/355.12
4,240,475 A * 12/1980 Schulz ..... B67D 7/32 141/392
4,540,017 A * 9/1985 Prange ..... B65H 75/441 137/355.12
5,515,593 A * 5/1996 Eagler ..... B67D 7/42 29/426.5
8,439,651 B2 * 5/2013 Gilpatrick ..... F04B 17/06 137/355.12
8,739,816 B2 * 6/2014 Chang ..... A62C 35/20 137/355.2
2014/0352807 A1 * 12/2014 Liu ..... B08B 3/026 137/355.27

* cited by examiner

*Primary Examiner* — Kevin Murphy
*Assistant Examiner* — Josephine Trinidad-Borges
(74) *Attorney, Agent, or Firm* — Dennis L. Thomte; Thomte Patent Law Office LLC

(57) ABSTRACT

A nozzle holder for a fuel hose reel including an upstanding support having its lower end positioned on a support surface. A hose reel is rotatably mounted on the upper end of the support and has a fuel hose wound thereon. An upstanding bracket is secured to the support at one side thereof and has a fuel containment assembly secured to the upper end thereof. The fuel containment assembly includes an inclined base tube having an elongated slot formed in the front wall thereof. An inclined fuel containment tube has its lower end selectively removably inserted into the open upper end of the base tube. The containment tube has an elongated opening formed in the front wall thereof. The nozzle of the fuel hose may be inserted into the opening in the containment tube and the hand guard of the nozzle may be inserted into the opening in the base tube.

13 Claims, 11 Drawing Sheets

NOZZLE HOLDER FOR A HOSE REEL

BACKGROUND OF THE INVENTION

Field of the Invention

This invention relates to a nozzle holder for a hose reel and more particularly to a nozzle holder for a fuel hose reel. More particularly, this invention relates to a nozzle holder for a fuel hose reel with the holder including a containment tube which is in communication with the spout of the nozzle to collect drops of fuel falling from the spout of the nozzle. Even more particularly, the invention relates to a nozzle holder for a fuel hose with the nozzle holder being mounted on a hose stand, a post, or a wall.

Description of the Related Art

Many types of fuel hose reels have been provided with those hose reels having a fuel hose wound thereon. One end of the fuel hose is fluidly connected to a source of fuel with the other end thereof having a fuel dispensing nozzle connected thereto. The fuel hose is unwound from the hose reel so that the nozzle may be inserted into a fuel container, tank, tractor, truck, etc. so as to dispense fuel thereinto. When the fuel dispensing operation has been completed, the nozzle is removed from the fuel container, etc. As the nozzle is removed from the fuel container, etc. and stowed, a few drops of fuel drop from the nozzle onto the ground or onto the person doing the fueling operation. If the hose reel is located within a compartment of a trailer or fuel hauler, those drops falling from the nozzle fall onto the floor of the compartment when the fuel hose is wound upon the hose reel and when the fuel nozzle is placed into the compartment. The drops of fuel, if falling onto the ground, create a pollution problem. The drops of fuel, if falling onto the compartment floor, create a mess and a pollution problem. The nozzle drip problem also results in fuel wastage.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

A nozzle holder for a fuel hose reel assembly is disclosed including an upstanding support frame having an upper end, a lower end, a first side, a second side, and a hose reel rotatably mounted on the support frame. A fuel hose is wound upon the hose reel with the fuel hose having a fuel dispensing nozzle including a discharge spout and a hand guard. A nozzle holder includes a vertically disposed support bracket having upper and lower ends with the lower end of the support bracket being secured to the first side of the support frame. An inclined support plate, having upper and lower ends, is secured to the upper end of the support bracket. An elongated and inclined hollow base tube is secured to the support plate with the base tube having an open upper end, a lower end, a front wall, a back wall, a first side wall and a second side wall. The front wall of the base tube has an elongated slot with upper and lower ends, formed therein at the lower end of the front wall of the base tube. The first side wall of the base tube has first and second pin openings formed therein below the upper end of the first side wall thereof.

An elongated and inclined hollow fuel containment tube is provided which has a closed lower end, a closed upper end, a front wall, a back wall, a first side wall and a second side wall. The containment tube has a pin receptacle secured thereto below the lower end thereof. The front wall of the containment tube has an elongated opening formed therein below the upper end thereof. The lower end of the containment tube is selectively removably received in the open upper end of the base tube with the opening in the front wall of the containment tube being positioned above the upper end of the front wall of the base tube. The opening in the front wall of the containment tube is configured to receive the spout of the nozzle and the slot in the front wall of the base tube is configured to receive the hand guard of the nozzle when the spout of the nozzle is positioned in the opening in the front wall of the containment tube. A pair of retaining pins are also provided to maintain the containment tube in the base tube and to maintain the end guard of the nozzle in the slot in the base tube.

Any drops of fuel dropping from the spout of the nozzle will be collected within the containment tube.

A modified form of the tube containment assembly is also described.

Although the nozzle holder of this invention is ideally suited for use with a hose reel, the nozzle holder may be used wherein a hose reel is not being used. The nozzle holder could be supported on a wall, a post, a hose stand, or other supporting structure.

These and other objects will be apparent to those skilled in the art.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DESCRIPTION OF THE PREFERRED EMBODIMENT

Figure 1:
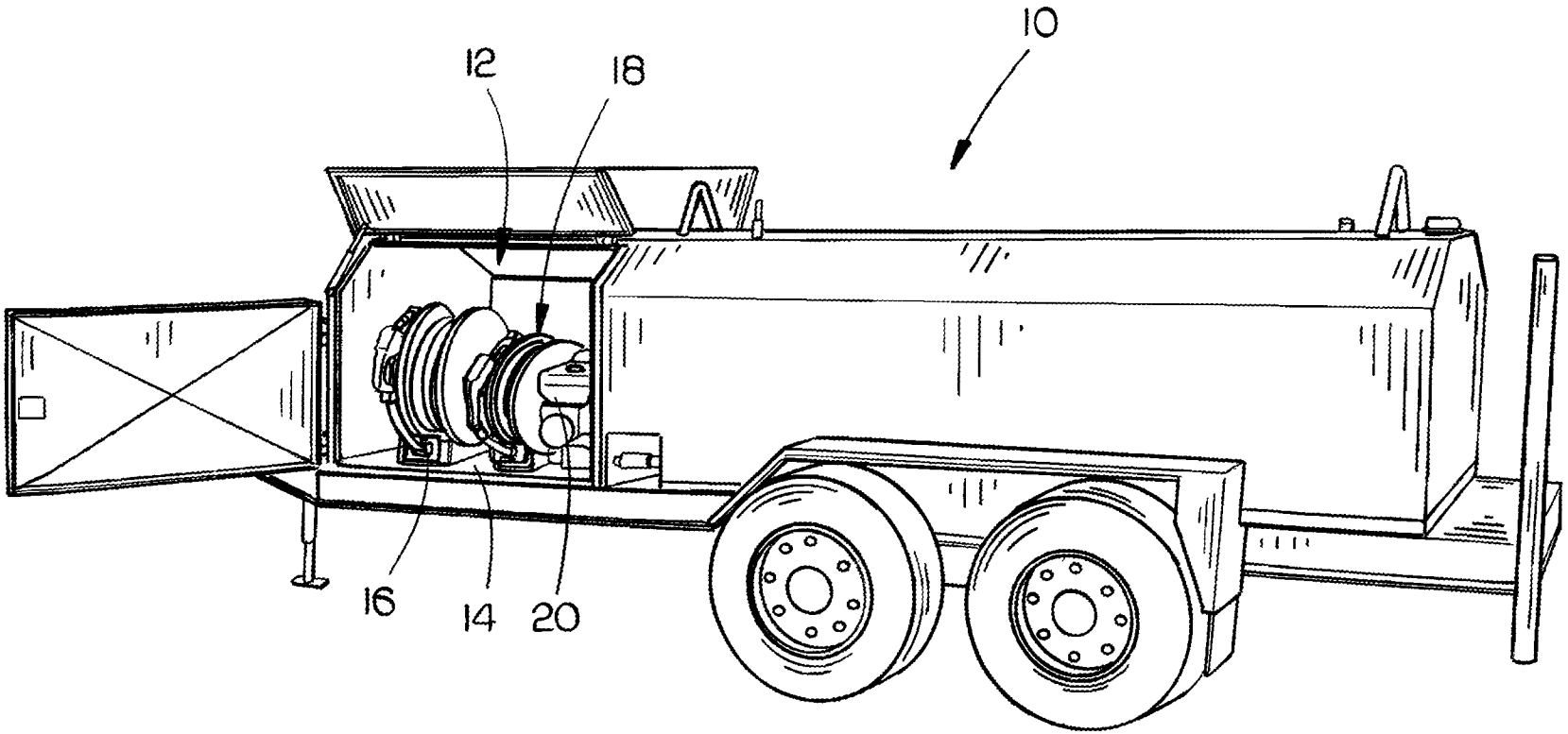
FIG. 1 is a perspective view of a fuel hauler trailer having a pair of fuel hose reels mounted in a compartment thereof.

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

The numeral 10 refers to a fuel hauler trailer capable of hauling diesel fuel and DEF. DEF is an acronym for Diesel Exhaust Fluid. Trailer 10 includes a compartment 12 at its forward end which has a floor 14. A diesel fuel hose reel assembly 16 is mounted in compartment 12. A DEF hose reel assembly 18 is also mounted in compartment 12. A motor-driven or electric driven pump 20 supplies diesel fuel to the diesel hose reel assembly and an electric driven pump supplies DEF to DEF hose reel assembly 18.

Hose reel assembly 16 includes an upstanding support frame 22, the lower end of which is secured to the floor 14. A diesel fuel hose 24 is wound upon reel 26 which is rotatably secured to the upper end of support frame 22 in conventional fashion. The inner end of hose 24 is in fluid communication with the pump 20. A nozzle 28 is secured to the outer end of hose 24 and includes a body portion 30, a discharge spout 32 and a hand guard 34.

Hose reel assembly 18 includes an upstanding support frame 36, the lower end of which is secured to floor 14. A DEF additive hose 38 is wound upon reel 40 which is rotatably secured to the upper end of support frame 36 in conventional fashion. The inner end of hose 38 is in fluid communication with the pump 20. A nozzle 42 is secured to the outer end of hose 38 and includes a body portion 44, a discharge spout 46 and a hand guard 48. The primary difference between hose reel assembly 16 and hose reel assembly 18 is that discharge spout 32 has a larger diameter than discharge spout 46. Although hose reel assembly 16 is described as being a diesel fuel hose reel assembly, the hose reel assembly 16 could also be used with other fuels such as gasoline, kerosene, etc. Although hose reel assembly 18 is described as a DEF hose reel assembly, the hose reel assembly 18 could also be used with other fuels or additives.

The hose reel assemblies 16 and 18 may be mounted on any support surface but are preferably mounted on the floor 14 of compartment 12.

Figure 2:
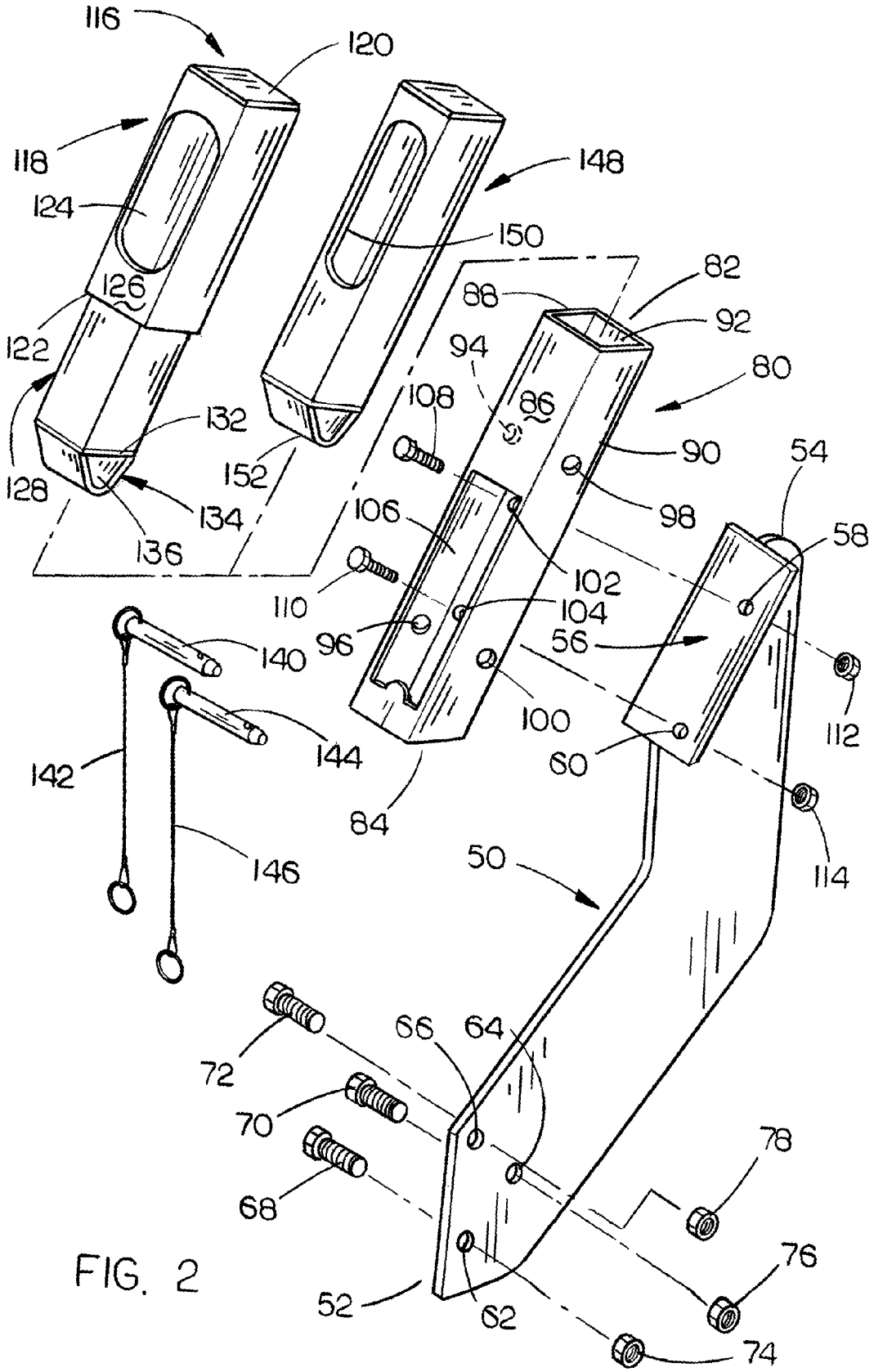
FIG. 2 is an exploded perspective view illustrating two versions of the nozzle holder of this invention.
Figure 3:
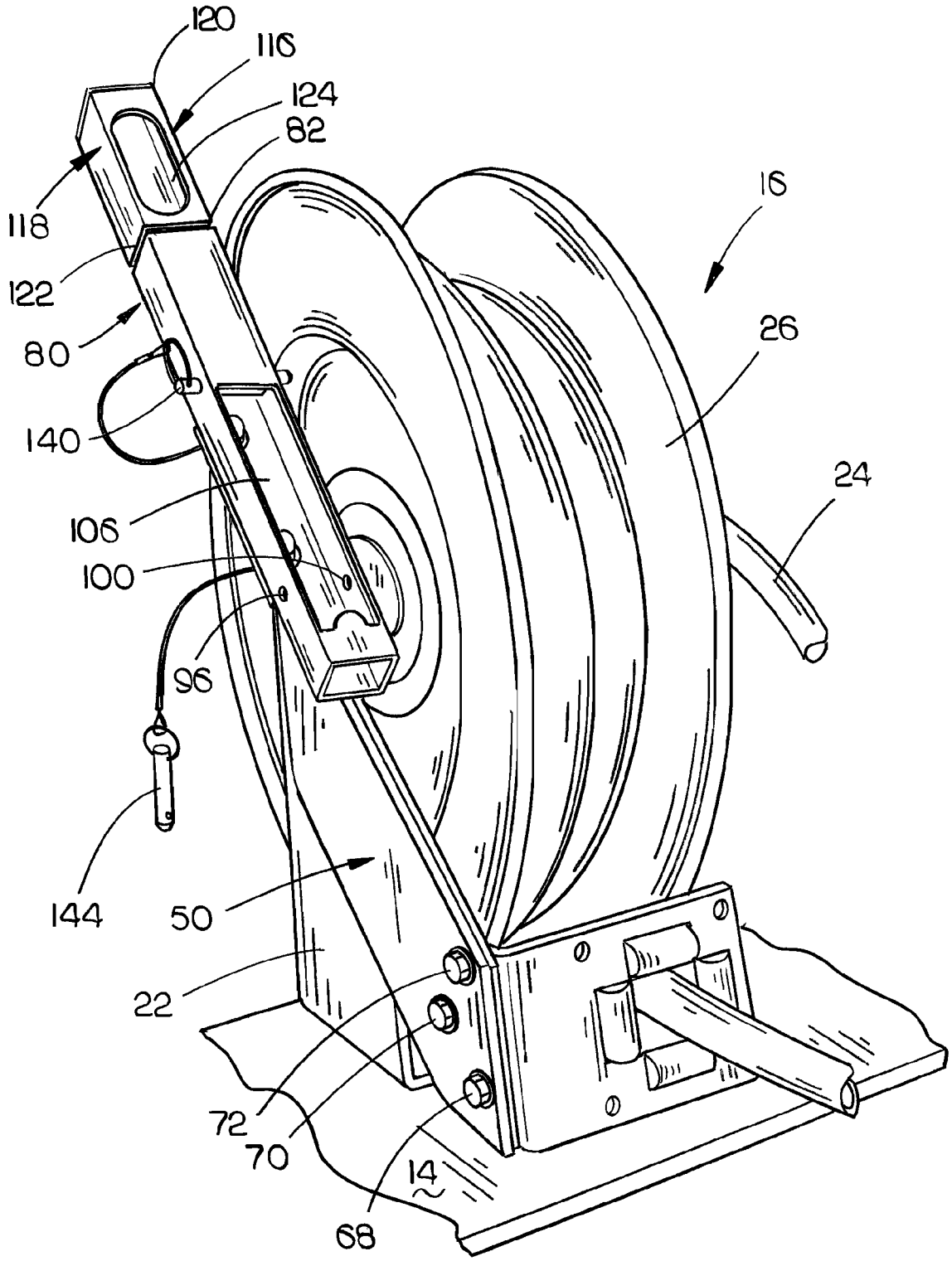
FIG. 3 is a perspective view of a first embodiment of the nozzle holder attached to a fuel hose reel.
Figure 4:
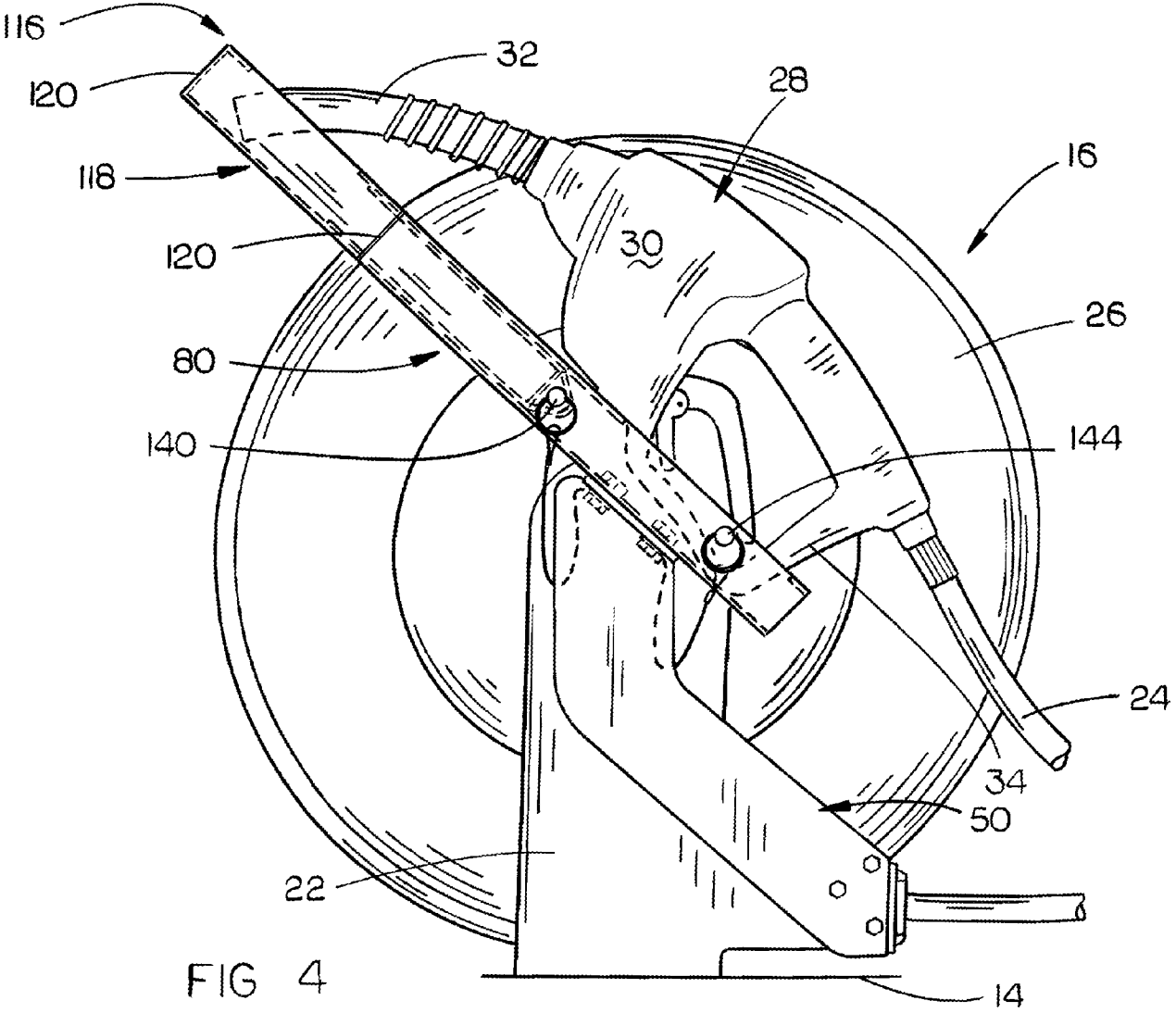
FIG. 4 is a side view of the hose reel and nozzle holder of FIG. 3.

With respect to hose reel assembly 16, the numeral 50 refers to an upstanding nozzle holder support bracket having a lower end 52 and an upper end 54. A flat support plate 56 is welded to bracket 50 at the upper end thereof as seen in FIG. 2. Plate 56 has a pair of bolt openings 58 and 60 formed therein. The lower end of bracket 50 has bolt openings 62, 64 and 66 formed therein. Bracket 50 is secured to one side of support frame 22 of hose reel assembly 16 by bolts 68, 70 and 72 which extend through bolt openings 62, 64 and 66 respectively and through openings formed in support frame 22. Nuts 74, 76 and 78 are threadably secured to the inner ends of bolts 68, 70 and 72 respectively to fixedly secure bracket 50 to support frame 22.

An upstanding nozzle support bracket 50, is secured to support frame 36 of hose reel assembly 18 in an identical manner as just described herein above.

The numeral 80 refers to an elongated, hollow, tubular drip confinement tube support or base tube having an upper end 82 and a lower end 84. Base tube 80 will be described as having a front wall 86, side walls 88 and 90, and back wall 92. Side wall 88 of base tube 80 has pin openings 94 and 96 formed therein. Side wall 90 of base tube 80 has pin openings 98 and 100 formed therein which are aligned with pin openings 94 and 96 in side wall 88. Back wall 92 of base tube 80 has bolt openings 102 and 104 formed therein. Front wall 86 of base tube 80 has an elongated opening 106 formed therein as seen in FIG. 2.

Base tube 80 is secured to plate 56 by bolts 108 and 110 which extend through openings 102 and 104 in back wall 92 of base tube 80, and through openings 58 and 60 in plate 56. Nuts 112 and 114 are threadably secured to bolts 108 and 110 respectively to fixedly secure base tube 80 to plate 56.

The numeral 116 refers to a drip containment tube assembly which is removably inserted downwardly into the upper end 82 of base tube 80. Drip containment tube assembly 116 includes an upper tube member 118 having an upper closed end 120 and a lower open end 122. Tube member 118 has an elongated opening 124 formed in the front wall 126 thereof. The elongated hollow assembly 116 also includes a hollow lower tube member 128 which has its upper end 130 inserted into the lower end of tube member 118 and is welded thereto. The lower end 132 of tube 128 has a V-shaped member 134 welded thereto which defines an opening 136.

The lower end of lower tube member 128 is selectively removably inserted downwardly into the open upper end 92 of base tube 80 until the lower end 122 of upper tube member 118 engages the upper end 92 of base tube 80. Locking pin 140 is then inserted inwardly through pin opening 94 in side wall 88 of base tube 80, through opening 136 in member 134 and through pin opening 98 in side wall 90 of base tube 80. Preferably, pin 140 includes a tether 142 for connection to some structure to prevent pin 140 from becoming lost when not being used.

Figure 5:
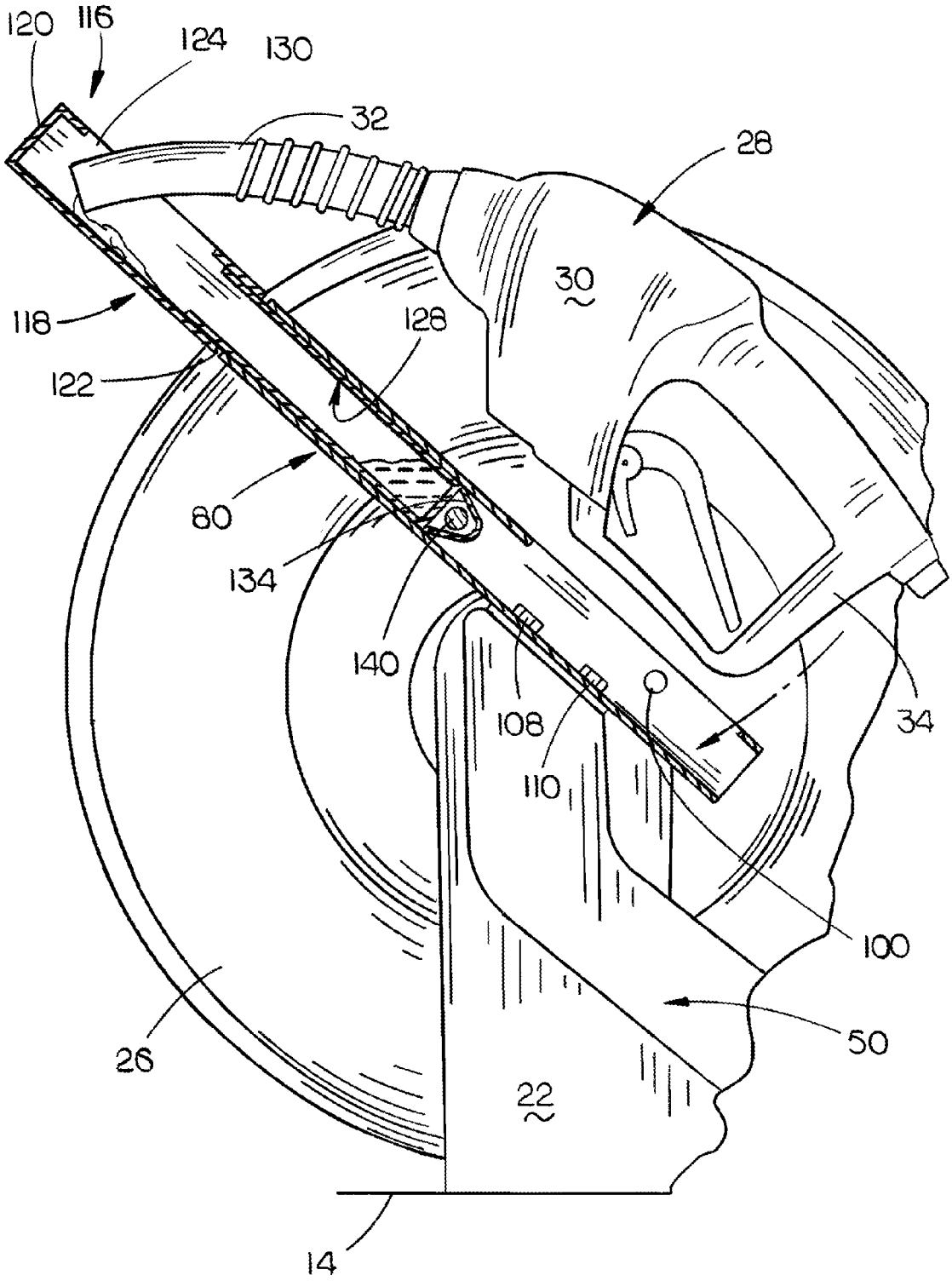
FIG. 5 is a view similar to FIG. 4 except that a portion thereof is cut away to more fully illustrate the invention.
Figure 6:
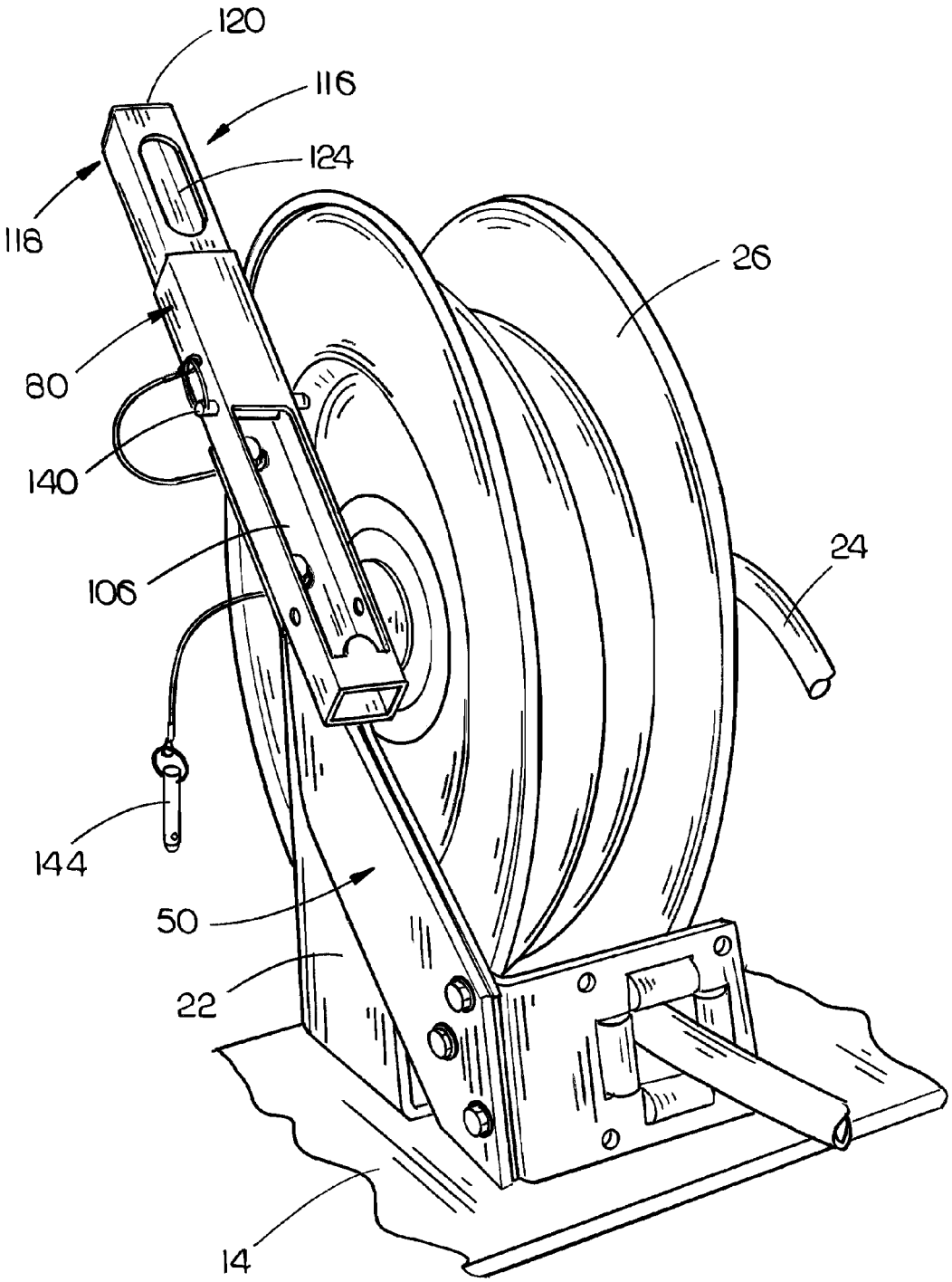
FIG. 6 is a perspective view of a second embodiment of the nozzle holder of this invention which is attached to a second fuel hose reel.
Figure 7:
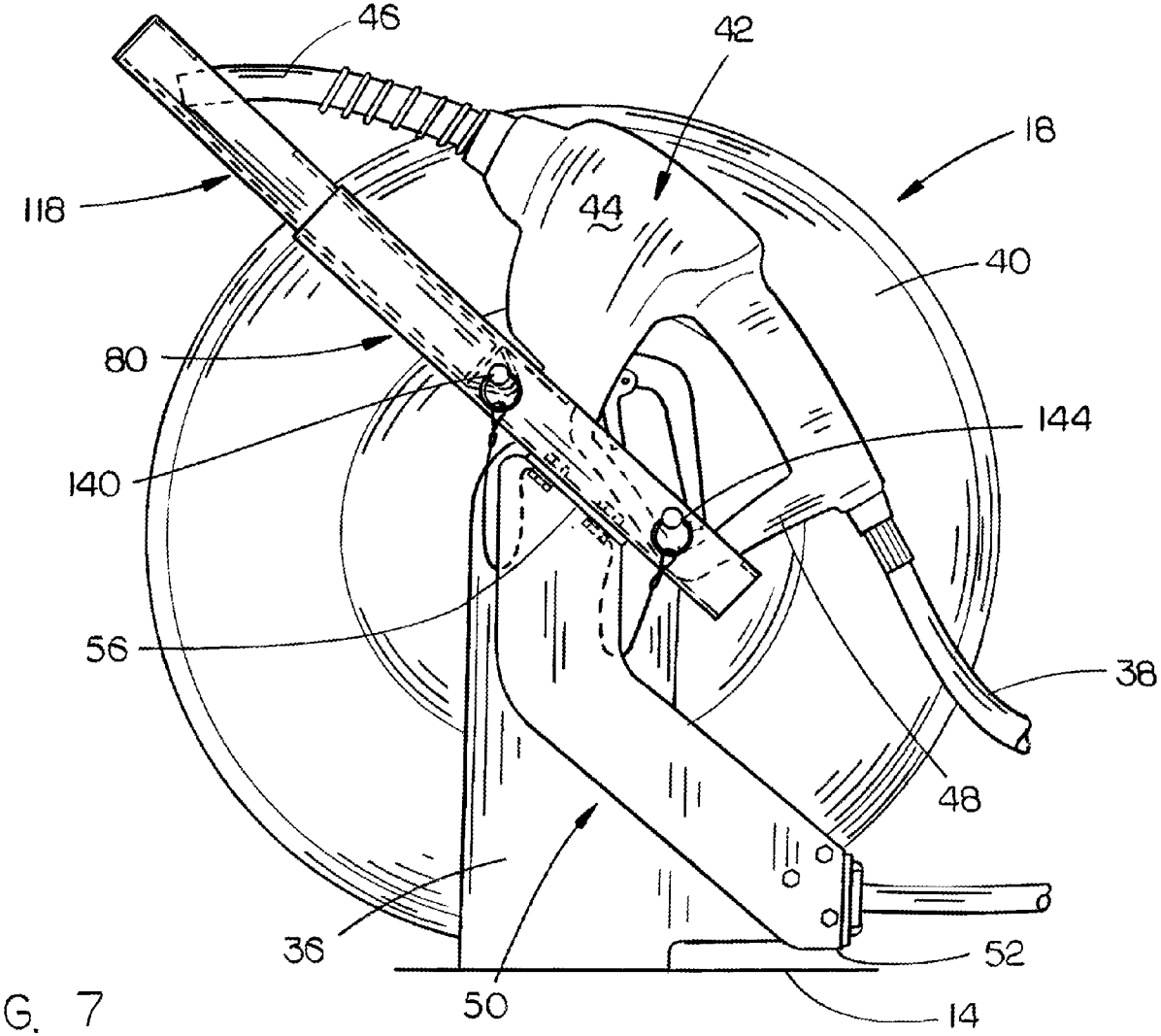
FIG. 7 is a side elevational view of the hose reel and nozzle holder of FIG. 6.
Figure 8:
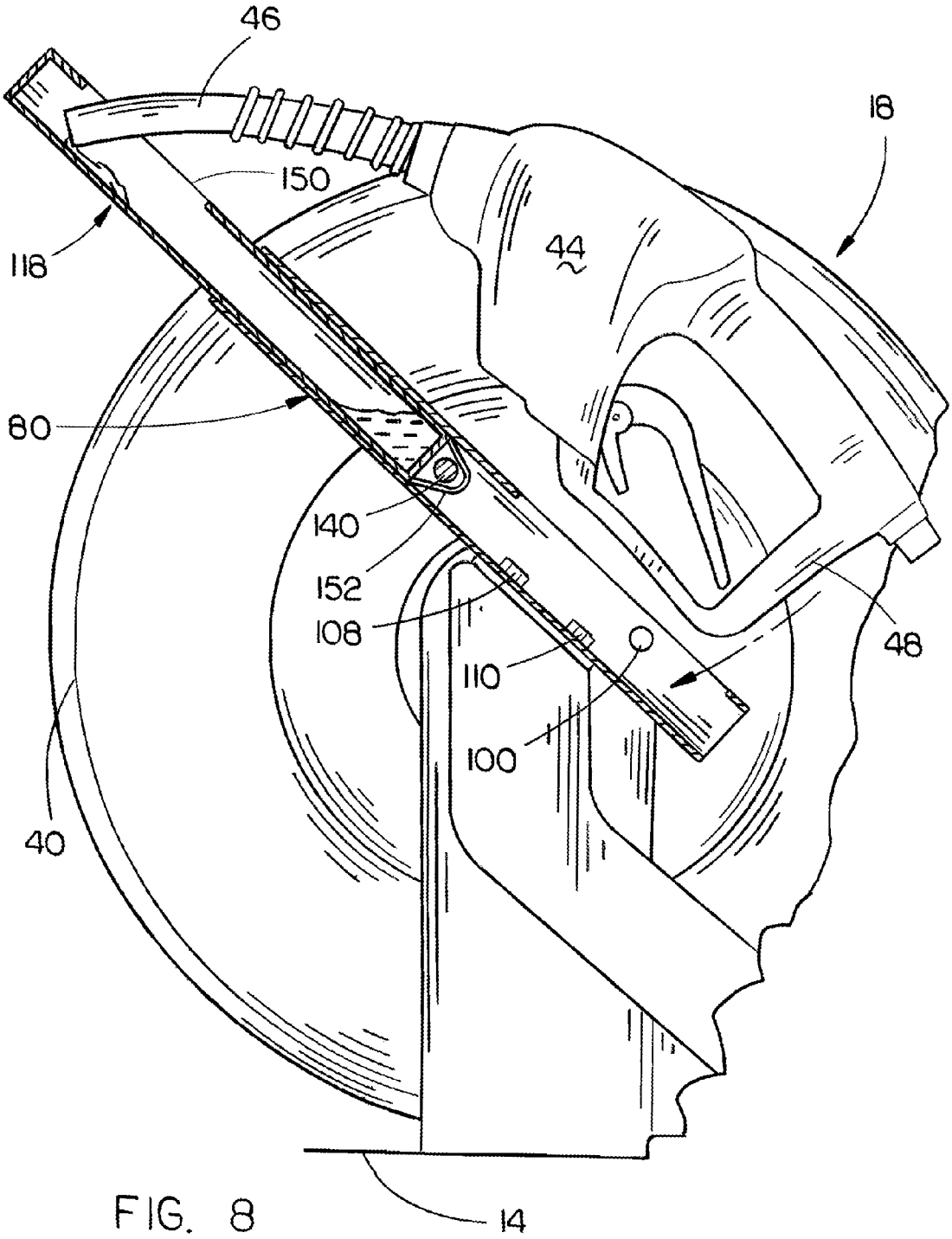
FIG. 8 is a partial side similar to FIG. 7 but which has a portion thereof cut away to more fully illustrate the invention.
Figure 9:
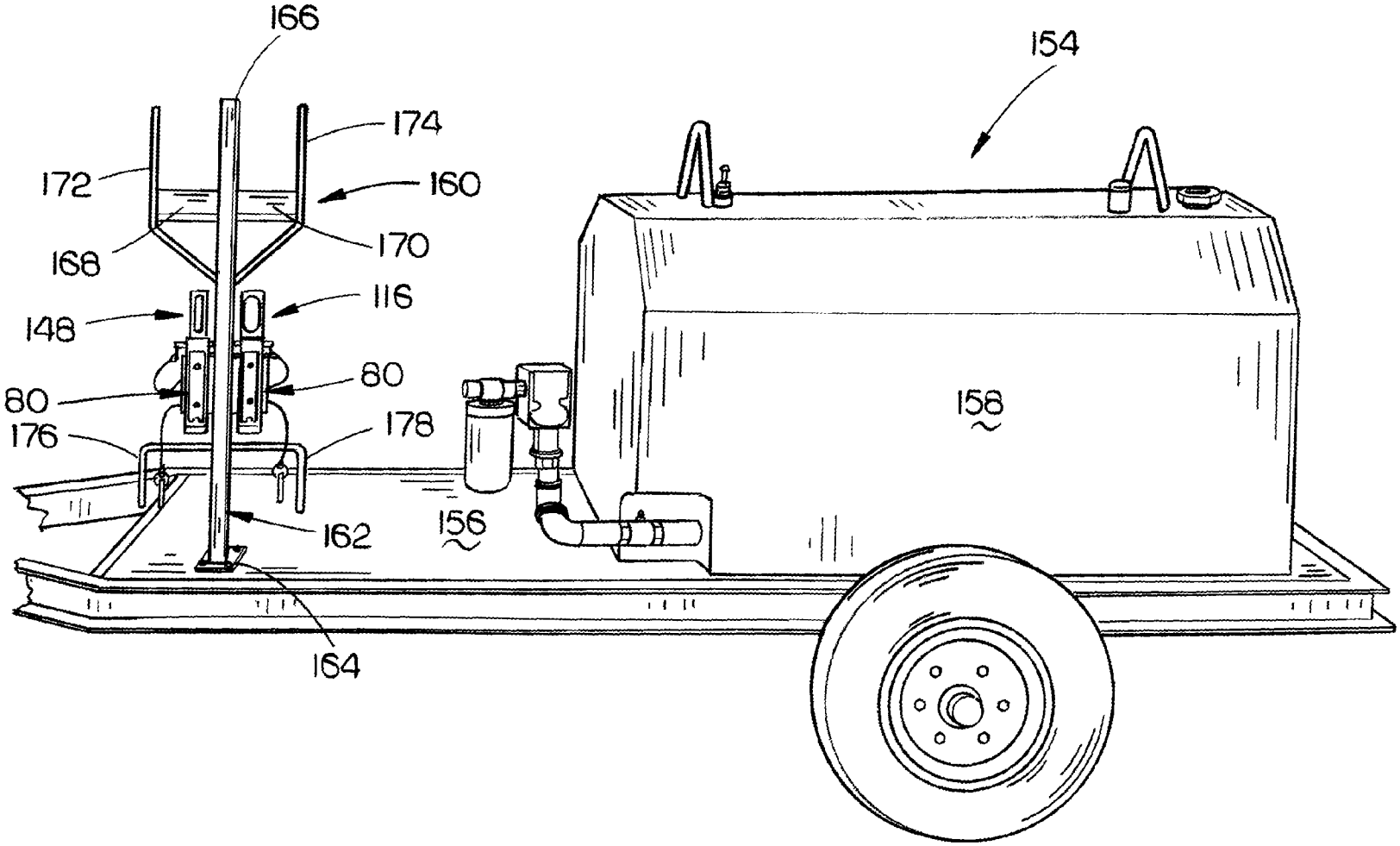
FIG. 9 is a side view illustrating the nozzle holders of this invention mounted on a hose stand which is secured to the forward end of a fuel trailer.

After the spout 32 of nozzle 28 has been removed from the fill opening of the tank, etc., the spout 32 is extended into the opening 124 as seen in FIG. 5 so that drips of fuel falling from the spout 32 will be collected in the interior of tube member 128 or seen in FIG. 5. The nozzle 28 is then moved inwardly so that the hand guard 34 is extended into the opening 106 in base tube 80 until hand guard 34 engages back wall 92 of base tube 80.

Locking pin 144 is then inserted inwardly through opening 96 in side wall 88 of base tube 80, through the hand guard 34, and through opening 100 in side wall 90 of base tube 80. The locking pins 140 and 144 ensure that the nozzle 28 will remain in the stowed position with respect to the base tube 80. Preferably, locking pin 144 also has a tether 146 secured thereto for connection to some structure to prevent pin 144 from becoming lost when not being used.

When the containment tube assembly 116 has collected a significant amount of fuel in tube member 128, the locking pins 140 and 144 are removed so that the nozzle 28 may be disconnected from the containment tube assembly 116 and the base tube 80. The drip containment assembly 116 is then removed from the base tube 80 so that the fuel therein may be deposited in a suitable repository.

The hose reel assembly 18 differs from the hose reel assembly 16 in that drip containment tube 148 is substituted for the drip containment tube assembly 116. Drip containment tube 148 has an opening 150 formed in the front wall of drip containment tube 148 which is longer and more narrow than the opening 124 in drip containment tube assembly 116. The drip containment tube 148 is inserted downwardly into the open upper end of base tube 80 until the V-shaped member 152 at the lower end of tube 148 is aligned with opening 94 in side wall 88 of base tube 80 and the opening 98 in side wall 90 of base tube 80. Locking pin 140 is then inserted through opening 94 in side wall 88 of base tube 80, through the V-shaped member 152, and through opening 98 in side wall 90 of base tube 80.

Thus it can be seen that the nozzle holder of this invention prevents drops of fuel or DEF from falling onto the ground if the hose reels are mounted in a location other than the compartment 12 and prevents drops of fuel or DEF from falling onto the floor 14 of compartment 12 if located therein.

As stated herein above, the nozzle holder of this invention may be used in situations wherein a hose reel is not being used. For example, the nozzle holder of this invention could be secured to a wall of a structure, on a post, a hose stand, or any other supporting structure. The nozzle holder of this invention could be used on a trailer wherein a hose reel is not being used. The nozzle holder of this invention could also be used in a compartment of a trailer without the use of a hose reel or on a platform of the trailer.

Figure 10:
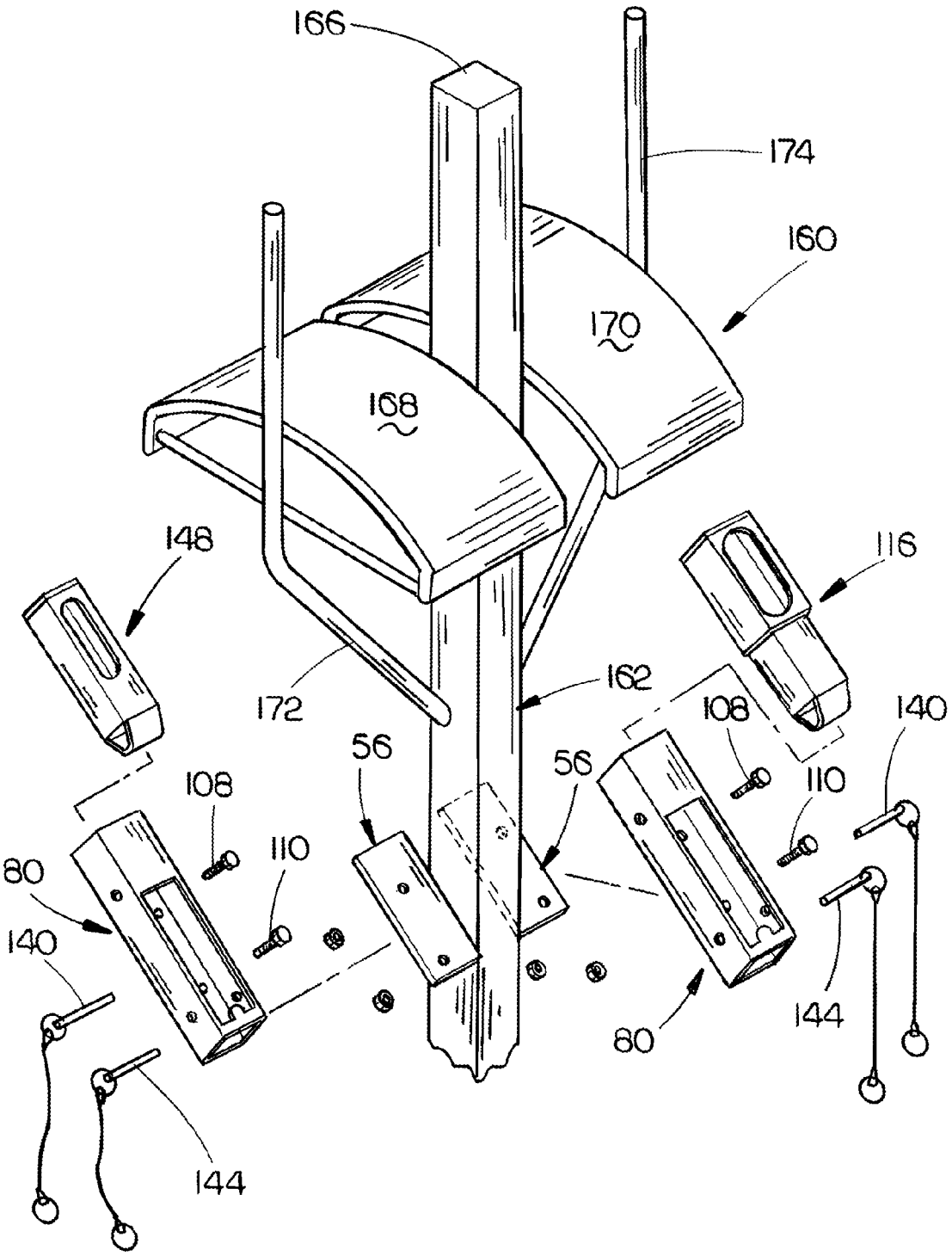
FIG. 10 is a partial exploded perspective view of the nozzle holders of this invention and the hose stand of FIG. 9.
Figure 11:
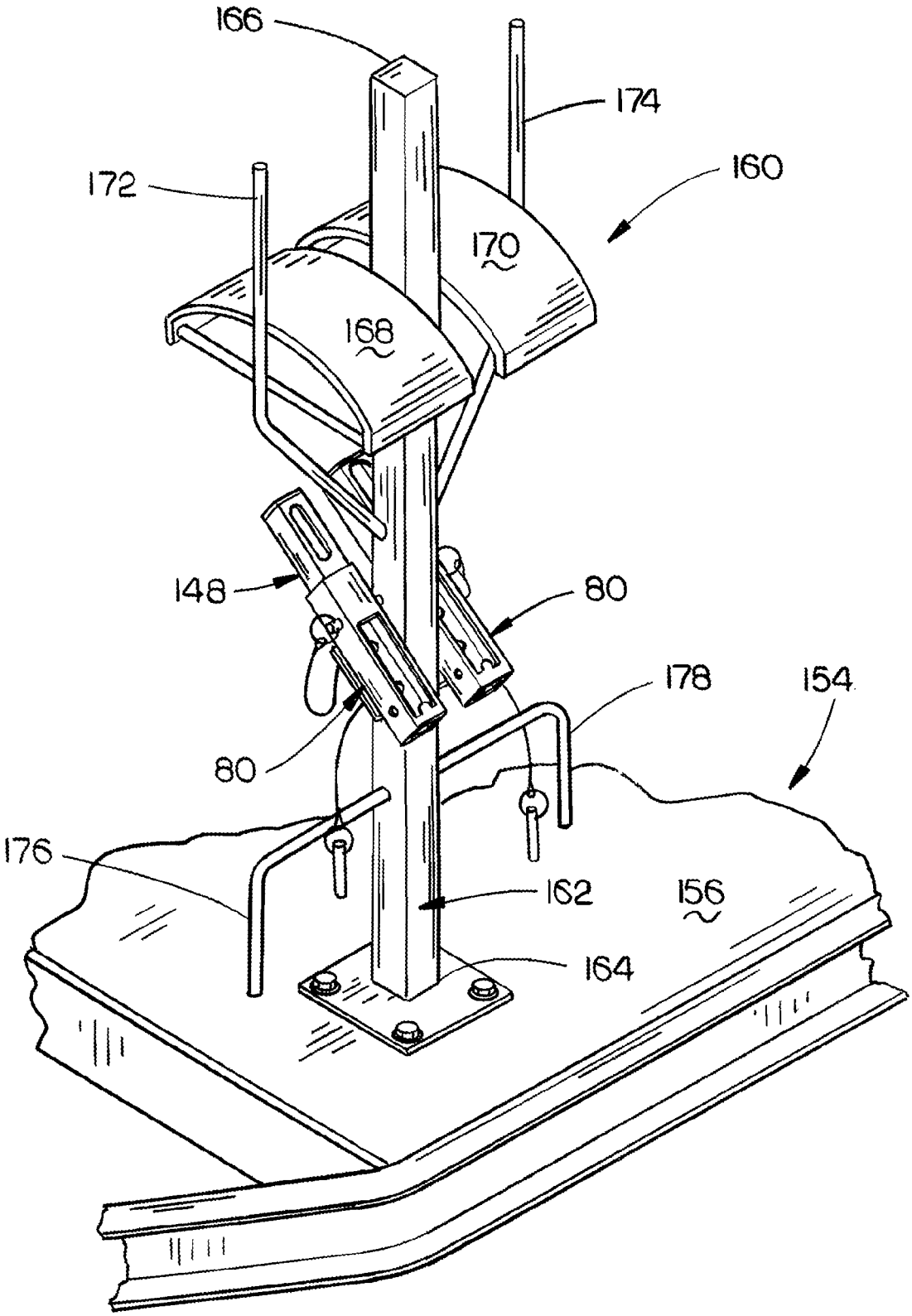
FIG. 11 is a partial perspective view illustrating the nozzle holders and hose stand of FIGS. 9 and 10.

In that regard, the numeral 154 refers to a fuel trailer which has an open area, deck or platform 156 forwardly of a fuel tank or tanks 158. The platform 156 of trailer 154 does not have hose reels positioned thereon but has a hose stand structure 160 thereon. Structure 160 includes an upstanding post or tube 162 having a lower end 164 and an upper end 166. The lower end 164 is secured to the platform of the trailer 154 by any convenient means. A pair of semi-circular hose supports 168 and 170 is secured to opposite sides of post 162 below the upper end for supporting hoses thereon such as hoses 24 and 38 thereon respectively. A pair of hose retaining arms 172 and 174 is secured to post 162 and hose supports 158 and 170 as illustrated in FIGS. 10 and 11. A pair of hose retaining arms or supports 176 and 178 is also secured to post 162 as seen in FIG. 11.

An inclined mount plate 56 is welded to one side of post 162 and an enclosed mount plate 56 is welded to the other side of post 162. The mount plates 56 on post 162 are identical to the mount plate 56 described hereinabove. A base tube 80 is bolted to each of the mount plates 56 and 56. A drip containment tube 116 is secured to one of the base tubes 80 and a drip containment tube 148 is secured to the other base tube 80. The nozzles of the hoses 24 and 38 are attached to those assemblies as described herein above.

The post 162 could be used in other ways besides on the trailer 154.

Thus it can be seen that the invention accomplishes at least all of its stated objectives.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

I claim:

1. A nozzle holder for a fuel hose reel assembly including an upstanding support frame having an upper end, a lower end, a first side, a second side, a hose reel rotatably mounted on the support frame, and a fuel hose wound upon the hose reel with the fuel hose having a dispensing nozzle for dispensing fuel including a discharge spout and a hand guard, comprising:

a vertically disposed support bracket having an upper end and a lower end;

said lower end of said support bracket being secured to the first side of the support frame;

an inclined support plate, having an upper end and a lower end, secured to said upper end of said support bracket;

an elongated and inclined hollow base tube secured to said support plate;

said base tube having an open upper end, a lower end, a front wall, a back wall, a first side wall and a second side wall;

said front wall of said base tube having an elongated slot with an upper end and a lower end, formed therein at a lower end of said front wall of said base tube;

said first side wall of said base tube having a first pin opening formed therein below an upper end of said first side wall thereof;

said second side wall of said base tube having a first pin opening formed therein below an upper end thereof which is aligned with said first pin opening in said first side wall of said base tube;

said first side wall of said base tube having a second pin opening formed therein below said first pin opening thereof;

said second side wall of said base tube having a second pin opening formed therein below said first pin opening thereof which is aligned with said second pin opening in said first side wall of said base tube;

an elongated and inclined hollow fuel containment tube having a closed lower end, an upper end, a front wall, a back wall, a first side wall and a second side wall;

said fuel containment tube having a pin receptacle at said lower end thereof;

said front wall of said fuel containment tube having an elongated opening formed therein below an upper end thereof;

said lower end of said fuel containment tube being selectively removably received in said open upper end of said base tube with said opening in said front wall of said fuel containment tube being positioned above said upper end of said front wall of said base tube;

said opening in said front wall of said containment tube configured to receive the spout of the dispensing nozzle and said slot in said front wall of said base tube being configured to receive the hand guard of the dispensing nozzle when the spout of the dispensing nozzle is positioned in said opening in said front wall of said containment tube;

a first pin extending through said first pin opening in said first side wall of said base tube, through said pin receptacle and through said first pin opening in said second side wall of said base tube to selectively maintain said fuel containment tube in said base tube; and a second pin extending inwardly through said second pin opening in said first side wall of said base tube, through the hand guard positioned in said slot in said front wall of said base tube and through said second pin opening in said second side wall of said base tube to selectively maintain said hand guard in said slot in said front wall of said base tube.

2. The nozzle holder of claim 1 wherein the fuel being dispensed is gasoline.

3. The nozzle holder of claim 1 wherein the fuel being dispensed is Diesel fuel.

4. The nozzle holder of claim 1 wherein the fuel being dispensed is kerosene.

5. The nozzle holder of claim 1 wherein the fuel being dispensed is DEF.

6. The nozzle holder of claim 1 wherein said hose reel is mounted on a trailer.

7. The nozzle holder of claim 6 wherein the hose reel is mounted in a compartment of a trailer.

8. The nozzle holder of claim 1 wherein the hose reel is mounted on a fuel hauler trailer.

9. The nozzle holder of claim 1 wherein a pair of the hose reels are positioned side-by-side and wherein each of the hose reels have a base tube and a fuel containment tube secured thereto.

10. The nozzle holder of claim 9 wherein one of the hose reels is a Diesel fuel hose reel and wherein the other hose reel is a DEF hose reel.

11. A nozzle holder for a fuel hose reel assembly including an upstanding support frame having an upper end, a lower end, a first side, a hose reel rotatably mounted on the support frame, and a fuel hose wound upon the hose reel with the fuel hose having a dispensing nozzle for dispensing fuel including a discharge spout and a hand guard, comprising:

a vertically disposed support bracket having an upper end and a lower end;

said lower end of said support bracket being secured to the first side of the support frame;

an inclined support plate, having an upper end and a lower end, secured to said upper end of said support bracket;

an elongated and inclined hollow base tube secured to said support plate;

said base tube having an open upper end, a lower end, a front wall, a back wall, a first side wall and a second side wall;

said front wall of said base tube having an elongated slot, with an upper end and a lower end, formed therein at a lower end of said front wall of said base tube;

said first side wall of said base tube having a first pin opening formed therein below an upper end of said first side wall thereof;

said second side wall of said base tube having a first pin opening formed therein below said upper end of said base tube which is aligned with said first pin opening in said first side wall of said base tube;

said first side wall of said base tube having a second pin opening formed therein below said first pin opening thereof;

said second side wall of said base tube having a second pin opening formed therein below said first pin opening thereof which is aligned with said second pin opening in said first side wall of said base tube;

an elongated and inclined hollow fuel containment tube assembly having an upper end and a lower end;

said fuel containment tube assembly including a hollow lower tube member having a closed lower end, an open upper end, a front wall, a back wall, a first side wall, a second side wall, and a pin receptacle at said lower end thereof;

said fuel containment tube assembly also including a hollow upper tube member having an upper end, a lower end, a front wall, a back wall, a first side wall and a second side wall;

said lower end of said hollow upper tube member embracing said upper end of said lower tube member and being secured thereto;

said front wall of the upper tube member having an elongated opening formed therein;

said lower end of said lower tube member being selectively removably received in said open upper end of said base tube with said opening in said front wall of said upper tube member being positioned above an upper end of said front wall of said base tube;

said lower end of said upper tube member being in engagement with said upper end of said base tube when said lower tube member is inserted into said base tube;

said opening in said front wall of said upper tube member configured to receive the spout of the nozzle and said slot in said front wall of said base tube being configured to receive the hand guard of the nozzle when the spout of the nozzle is positioned in said opening in said front wall of said upper tube member of said fuel containment tube assembly;

a first pin extending through said first pin opening in said first side wall of said base tube, through said pin receptacle and through said first pin opening in said second side wall of said base tube to selectively maintain said containment tube assembly in said base tube; and a second pin extending inwardly through the second pin opening in said first side wall of said base tube, through the hand guard positioned in said slot in said front wall of said base tube and through said second pin opening in said second side wall of said base tube to selectively maintain said hand guard in said slot in said front wall of said base tube.

12. The nozzle holder of claim 11 wherein said upper end of said upper tube member of said fuel containment assembly is closed.

13. The nozzle holder of claim 11 wherein a pair of the hose reels are positioned side-by-side and wherein each of the hose reels has a base tube and a fuel containment assembly secured thereto.

* * * * *